US007346986B2

(12) United States Patent
Feith

(10) Patent No.: US 7,346,986 B2
(45) Date of Patent: Mar. 25, 2008

(54) CUTTING TOOL FOR FLEXIBLE CONDUIT

(75) Inventor: Raymond P. Feith, Chino Hills, CA (US)

(73) Assignee: Rain Bird Corporation, Azusa, CA (US)

( * ) Notice: Subject to any disclaimer, the term of this patent is extended or adjusted under 35 U.S.C. 154(b) by 0 days.

(21) Appl. No.: 11/361,716

(22) Filed: Feb. 23, 2006

(65) Prior Publication Data

US 2007/0193035 A1 Aug. 23, 2007

(51) Int. Cl.
*B26B 13/00* (2006.01)

(52) U.S. Cl. ..... 30/92; 30/258

(58) Field of Classification Search ..... 30/92, 30/112, 254, 258, 186, 191; D8/60
See application file for complete search history.

(56) References Cited

U.S. PATENT DOCUMENTS 4,092,774 A * 6/1978 Watts ..... 30/92
4,176,450 A * 12/1979 Muromoto ..... 30/92
4,336,652 A 6/1982 Robertson
D266,736 S * 11/1982 Robertson ..... D8/98
4,785,538 A * 11/1988 Meyer ..... 30/258
6,370,780 B1 * 4/2002 Robertson et al. ..... 30/261
6,658,738 B1 * 12/2003 King ..... 30/92
2005/0198833 A1 * 9/2005 Lin ..... 30/131

OTHER PUBLICATIONS

Photograph of a cutting tool publically available from Rain Bird Corporation prior to Feb. 23, 2005.

* cited by examiner

*Primary Examiner*—Hwei-Siu C. Payer
(74) *Attorney, Agent, or Firm*—Fitch, Even, Tabin & Flannery

(57) ABSTRACT

A tool for cutting flexible plastic conduit having a pair of pivotally attached handles. One of the handles includes a cutting blade. The cutting blade cooperatively associates with an anvil located on the other handle. The cutting blade and anvil form a cutting jaw. The anvil includes at least one support to resist deformation of the flexible conduit during the cutting operation. The support is shaped to conform to a portion of the exterior profile of the flexible pipe being cut. A slot bisects the anvil such that the cutting blade can completely pass through the conduit and the supports.

15 Claims, 10 Drawing Sheets

CUTTING TOOL FOR FLEXIBLE CONDUIT

FIELD OF THE INVENTION

The present invention relates to a tool for cutting flexible conduit, and more particularly, to a cutting tool that provides enhanced support to resist deformation of the conduit during cutting.

BACKGROUND OF THE INVENTION

Conduit is manufactured in bulk quantities extending much longer than needed in many applications. Plastic pipe or tubing of this type is often spun around large spools for convenient shipping and storage. When a portion of pipe is needed, a segment must be cut from the larger spool. Sections are cut according to specific length requirements. To separate the pipe into usable portions, a cutting tool is required. Sectioning of the pipes should result in a clean cut that allows for the pipes to be easily attached to pipe fittings. For example, in the installation of irrigation networks the piping is usually cut on-sight, preferably with a lightweight handheld tool, into the desired pipe segments to construct the network.

Typically, lightweight cutting-tools have a pair of handles that are pivotally attached to one another, and are operated to cause a cutting jaw, formed by a cutting blade and an anvil to squeeze down and cut the conduit. A major shortcoming with these cutting tools is pipe deformation. Since the pipe material is flexible or malleable, when the cutting jaw squeezes the pipe between its blade and opposing anvil, the cross-section of the pipe changes shape. That is, the cross-section of the pipe flattens to an oval or egg shape, instead of retaining its preferred circular shape.

After the cutting operation is finished, the pipe does not necessarily return to its circular cross-section but, instead, remains in the deformed shape. This requires manual reshaping of the pipe to a pre-cut circular cross-sectional shape before the pipe can be attached to any fittings, for instance, many junction fittings require the conduit have a circular cross-section in order to be received into the socket. In addition, deformation during the cutting process tends to cause an uneven cut, which may require that section of pipe to be recut.

Where large irrigation networks are installed, many pipe cuts are made during the construction process, and thus, lots of pipe reshaping and/or recutting is required. Such reshaping or recutting consumes valuable time, which decreases productivity and increases the cost of installations.

In addition to being a time saver, a tool used on-site is preferably versatile. The piping or tubes used typically vary in diameter, and therefore, cutting tools are preferably universal in nature to be used with different diameters and materials. Versatility can decrease the number of tools that the installer must carry to install irrigation networks.

Accordingly, there is a need for an improved cutting tool for sectioning flexible pipe that does not cause deformation in the pipe during the cutting operation.

DESCRIPTION OF THE PREFERRED EMBODIMENTS

Figure 1:
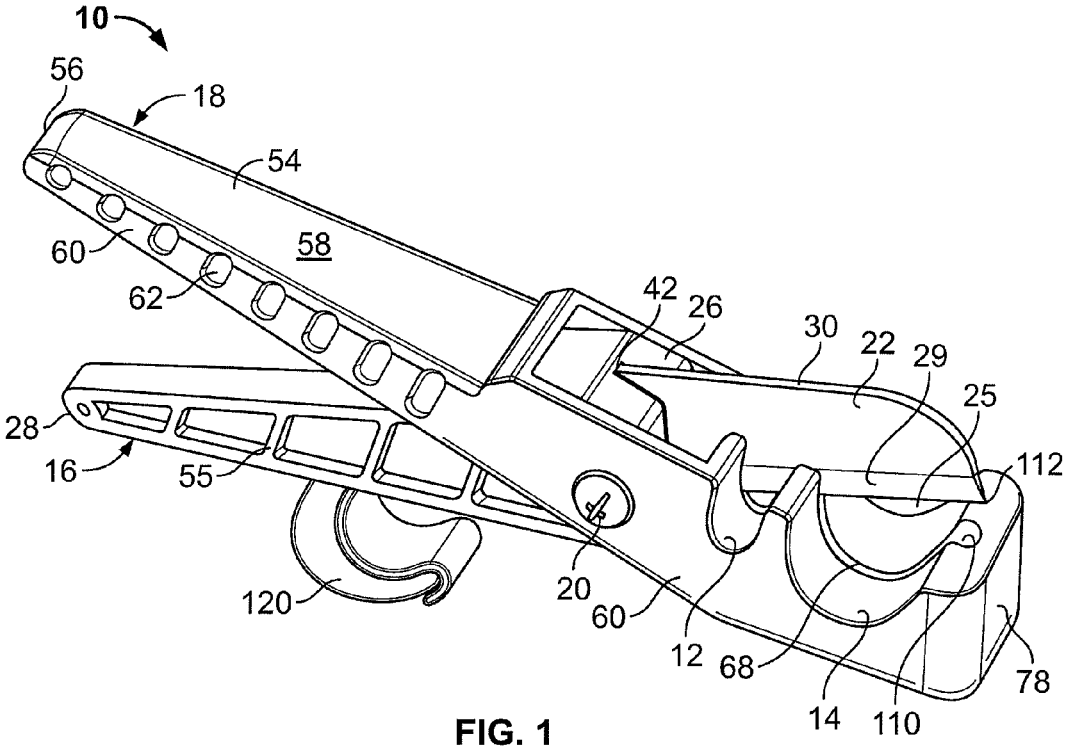
FIG. 1 is a perspective view of a cutting tool embodying features falling within the scope of the present invention.

With reference to FIG. 1, there is illustrated a tool 10 for cutting flexible plastic pipe or conduit, such as conventional polyvinyl or polyethylene conduit. The cutting tool 10 provides support against deformation of the pipe's cross section during cutting. More particularly, as explained in further detail below, the tool has two arcuate concave supports 12 and 14 that resist pipe deformation during cutting operations.

Figure 2:
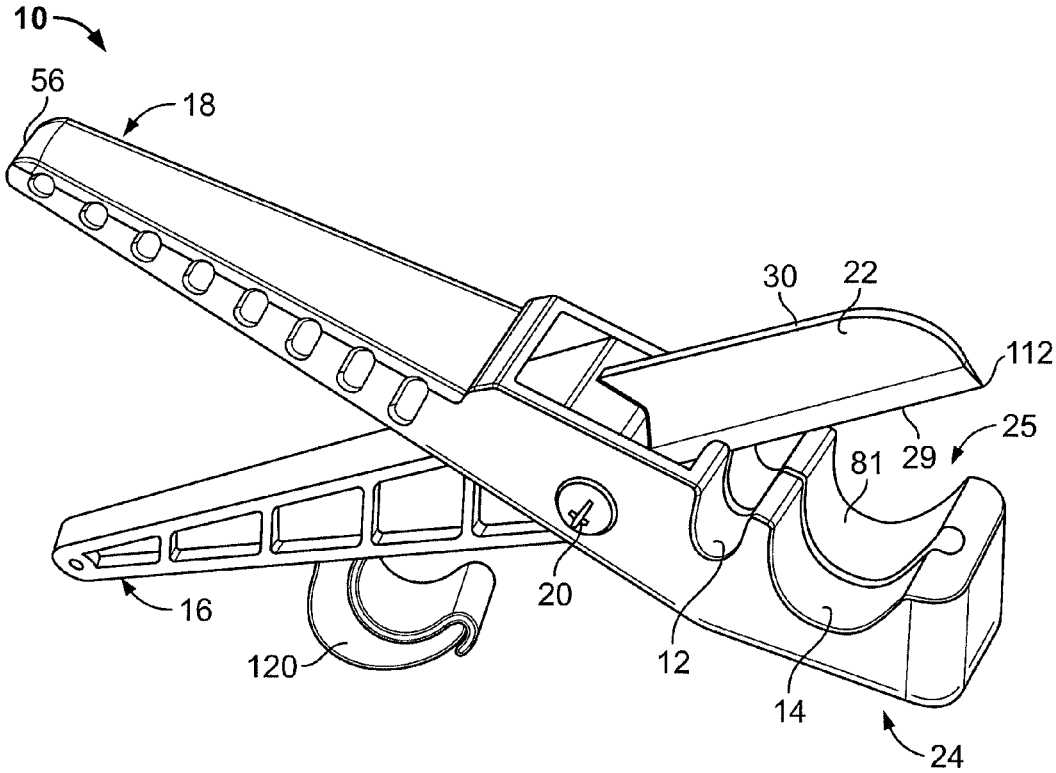
FIG. 2 is another perspective view of the cutting tool of FIG. 1 in a further open position than that illustrated in FIG. 1.
Figure 3:
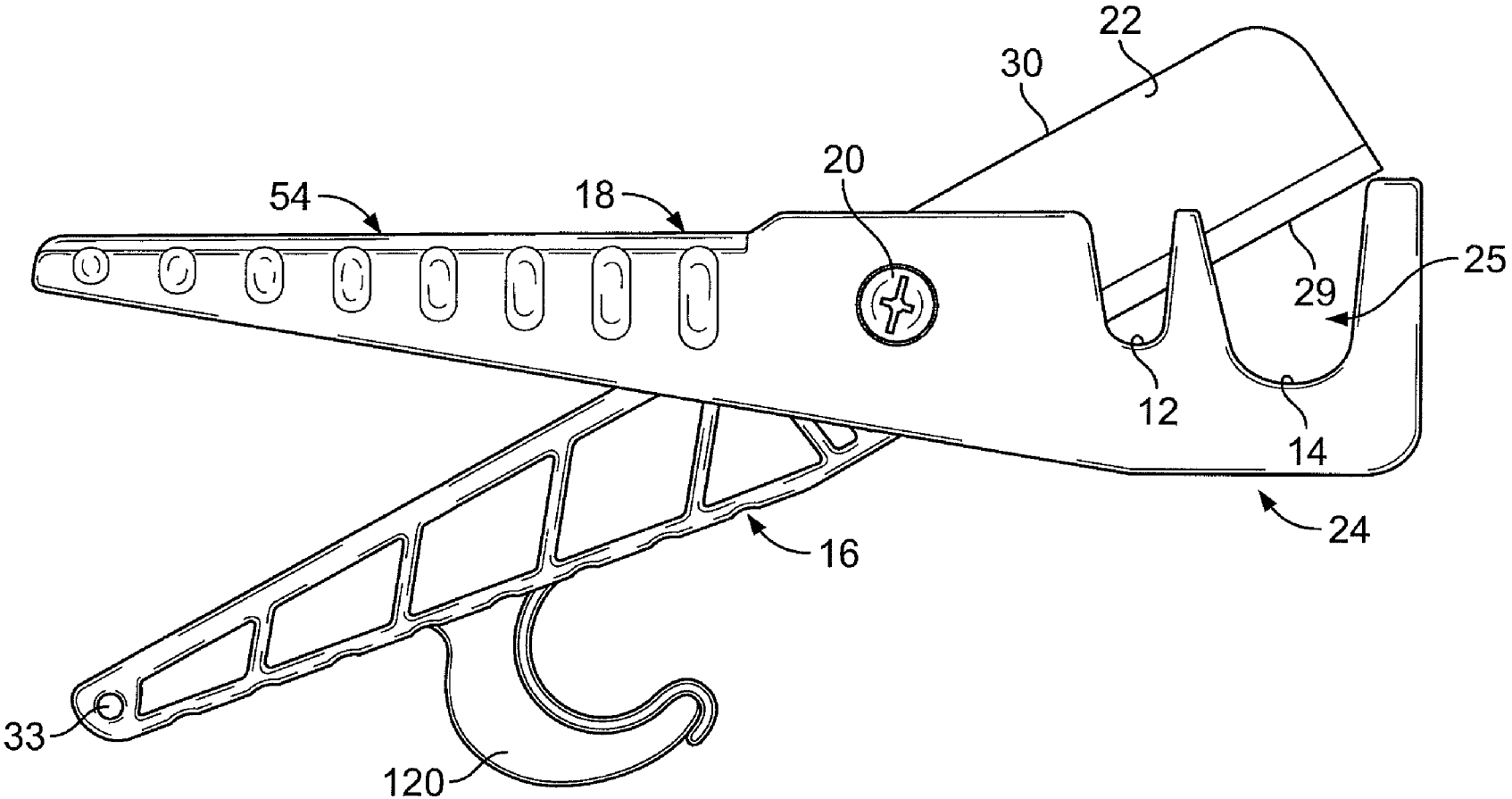
FIG. 3 is a side elevational view of the cutting tool of FIG. 1.
Figure 4:
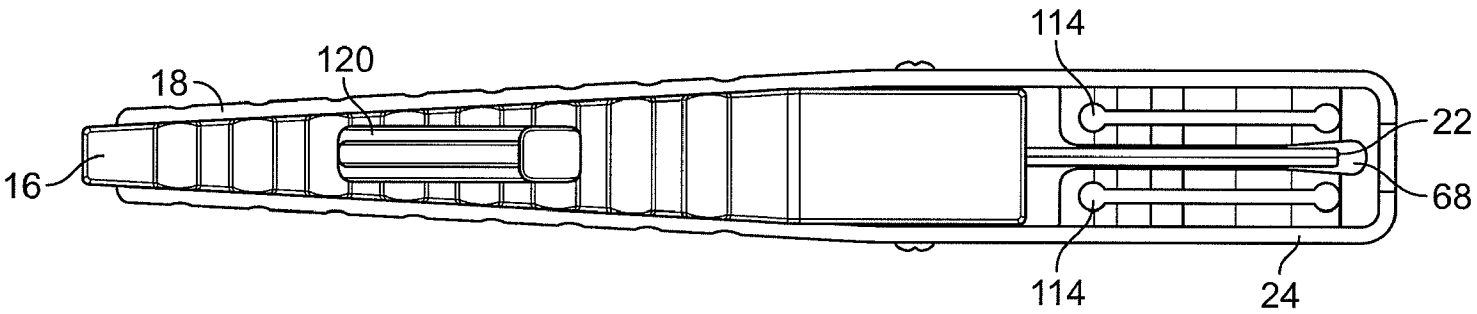
FIG. 4 is a bottom plan view of the cutting tool of FIG. 1 in the closed position.
Figure 5:
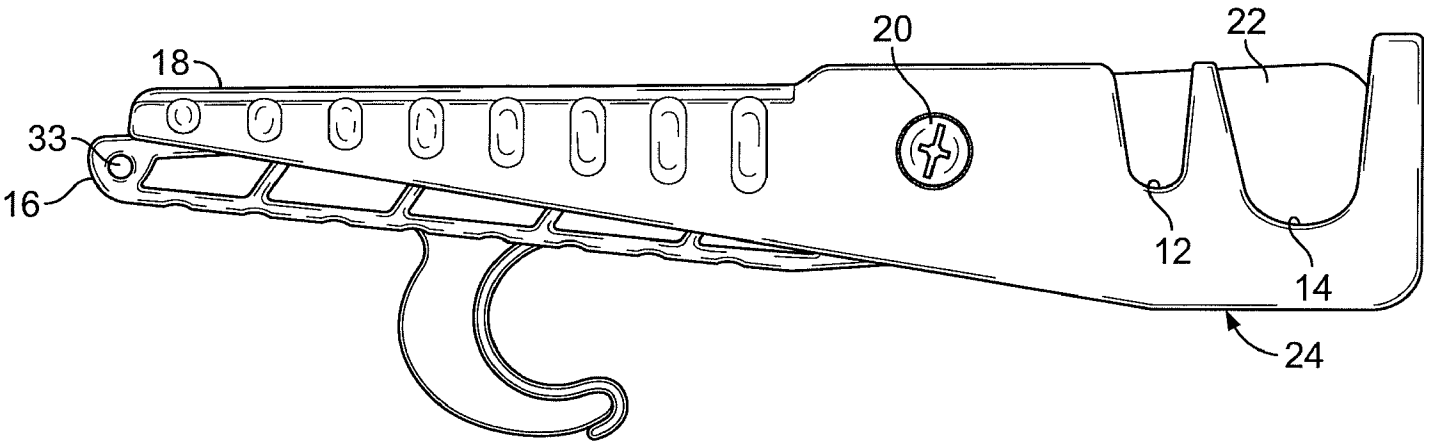
FIG. 5 is another side elevational view of the cutting tool of FIG. 1 in the closed position.
Figure 6:
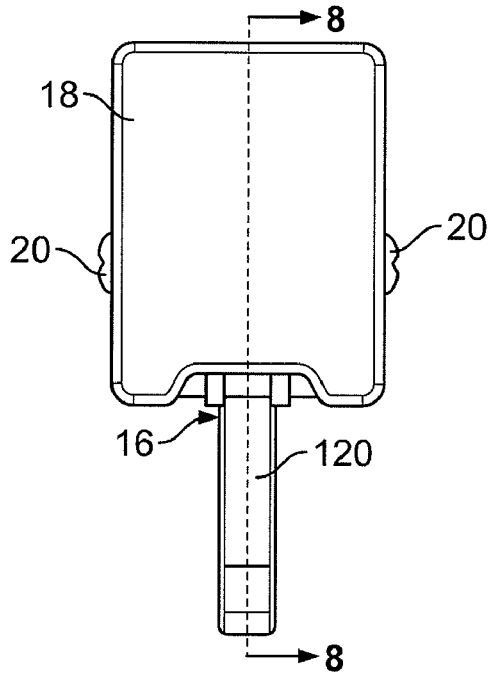
FIG. 6 is a front elevational view of the cutting tool of FIG. 1 in the closed position.

As shown in FIGS. 1 and 2, the cutting tool 10 includes a pair of elongated handles 16 and 18. The first elongate handle 16 and the second elongate handle 18 are pivotally connected to one another by a removable pin 20. The first handle 16 includes a knife or cutting blade 22 extending from one end that cooperatively associates with an anvil 24 extending from one end of the second handle 18. The anvil 24 includes the arcuate concave supports 12 and 14 that are shaped and sized to resists deformation of the pipe during cutting operations. When the handles 16 and 18 are assembled, the cutting blade 22 and the opposing anvil 24 form a cutting jaw 25. The handles 16 and 18 nest together in the closed position, as depicted in FIG. 5, to facilitate a clean and complete cut through the pipe.

Figure 8:
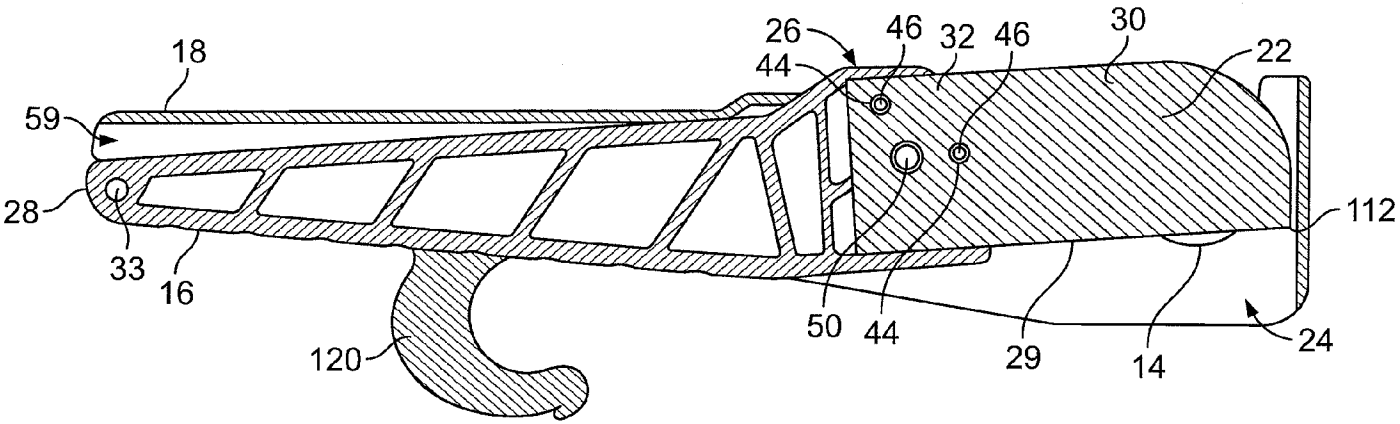
FIG. 8 is a cross-sectional view of the cutting tool of FIG. 1 taken along line 8-8 of FIG. 6.

With reference to FIGS. 1 and 8, the first handle 16 has a first end 26 and a second end 28. The first end 26 mounts the longitudinally extending cutting blade 22. The cutting blade 22 includes a longitudinally extending cutting edge 29 and, opposite the cutting edge 29, is a longitudinally extending knife spine 30. The blade 22 also includes a knife heel 32 that attaches the blade 22 to the handle 16. The first handle 16 tapers from the first end 26 to the second end 28. The second end 28 takes on a rounded or blunt shape and defines a transversally positioned hole 33 that can be used to attach a loop of string or strap or hook to the cutting tool 10.

Figure 7:
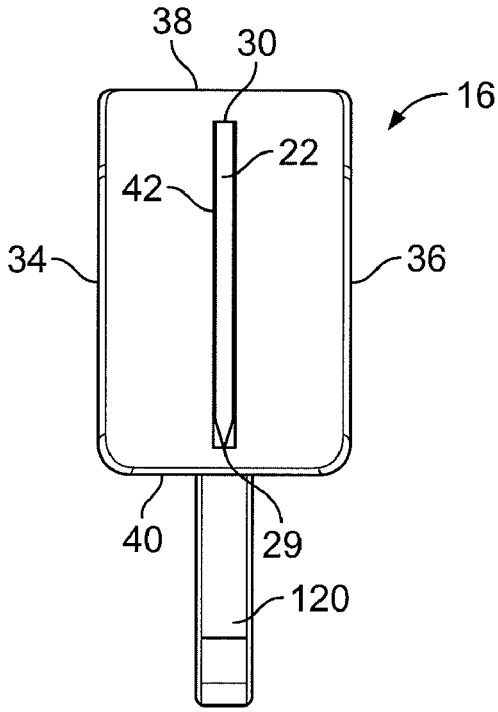
FIG. 7 is a front elevational view of one handle of the cutting tool of FIG. 1 including a cutting blade.
Figure 9:
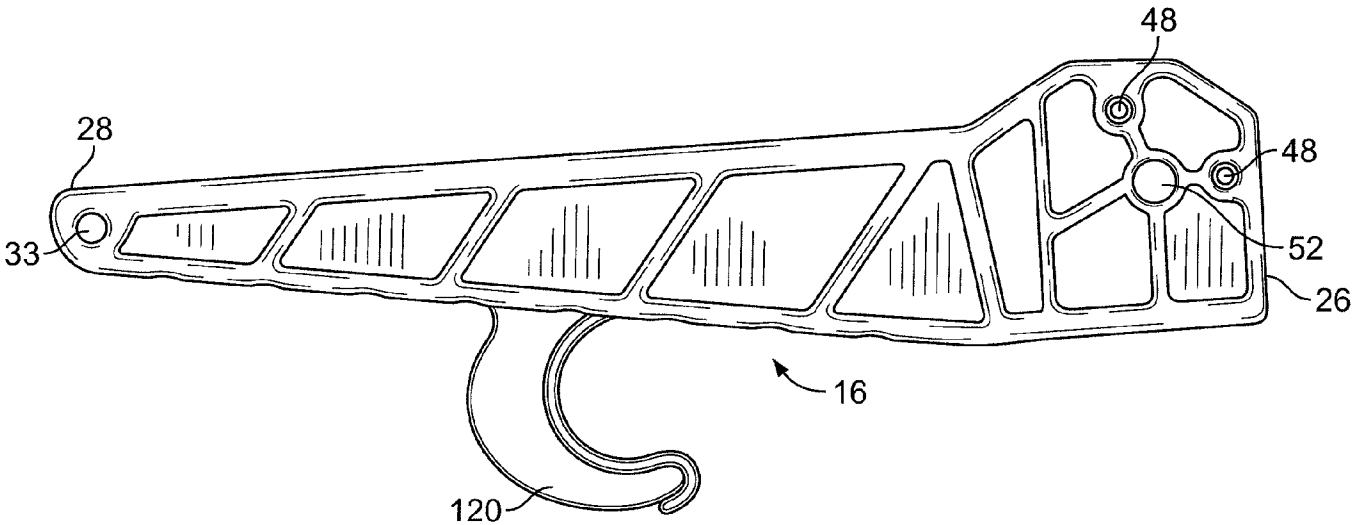
FIG. 9 is a side elevational view of one handle of the cutting tool of FIG. 1 without a cutting blade.

As illustrated in FIGS. 7 and 8, the first handle 16 has a blade-receiving slot 42 located centrally in the end 26. The portion of the handle 16 at the first end 26 has a rectangular cross-section constructed of a pair of sides 34 and 36, a top wall 38 and a bottom wall 40. The knife spine 30 is positioned adjacent to the top wall 38, while the cutting edge 29 is positioned adjacent to the bottom wall 40. The blade heel 32 defines three openings used to secure the blade 22 into position. When the cutting blade 22 is inserted into the handle 16, it is secured in place by a pair of roll pins 44. The roll pins 44 extend through openings 46 defined by the blade 22 and corresponding openings 48 defined by the sidewalls 34 and 36. The cutting blade 22 is also provided with a third opening 50 for pivot pin 20 to extent through. As shown in FIG. 9, a pivot pin opening 52 also extends through the first handle 16 from one side 34 to the other side 36. Together, the corresponding apertures 50 and 52 align to receive the pivot pin 20. The cutting blade apertures 46 and 50 securely attach the cutting blade 22 to first handle 16 by arranging the pin apertures 46 so that relative movement between the first handle 16 and the cutting blade 22 is minimized.

If the cutting edge 29 becomes dull, the cutting blade 22 can be replaced. Replacing the cutting blade 22 requires one to remove the pivot pin 20 and, then, separate the handles 16 and 18. Once separated, the roll pins 44 can be pushed out of the corresponding apertures 46 and 48 of the first handle 16. By removing the pivot pin 20 and the roll pins 44, the cutting blade 22 is released from the first handle 16. After removing the dull cutting blade, a new cutting blade is inserted, and the roll pins 44 are reinserted in the aligned apertures 46 and 48 followed by mating the handles 16 and 18 and by reinserting the pivot pin 20.

As shown in FIG. 1, the second handle 18 cooperatively associates with the first handle 16 to form the cutting tool 10. The second handle 18 is an elongated member defining at one end a handle gripping section 54 corresponding to a handle gripping section 55 of the first handle 16. The anvil 24 extends from the other end of the second handle. As will be discussed in more detail below, the anvil 24 includes two arcuate, concave supports 12 and 14. The supports 12 and 14 extend transverse relative to the cutting blade 22 and are located adjacent to one another along the anvil 24.

With reference to FIGS. 10-13, the handle gripping section 54 of the second handle 18 includes a middle panel 58 and a pair of depending sidewalls 60 that extend along the entire length of the second handle 18, from anvil 24 to a rear end 56. The panel 58 and the depending sidewalls 60 form a U-shaped channel 59 in which the corresponding handle gripping sections 55 of the first handle 16 nests when the cutting blade 22 is in the lowered and closed position (see also FIG. 5). The second handle 18 includes depressions 62 located on the gripping section 54. The depressions 62 enhance gripping of the cutting tool 10 during use. Each of the sidewalls 60 of the second handle 18 defines a pivot pin aperture 64. When the apertures 64 are aligned with the pivot pin apertures 52 of the first handle 16 and the pivot pin aperture 50 of the cutting blade 22, the pivot pin 20 can be inserted into position such that cutting tool 10 is assembled, as shown in FIGS. 1 and 2.

Figure 12:
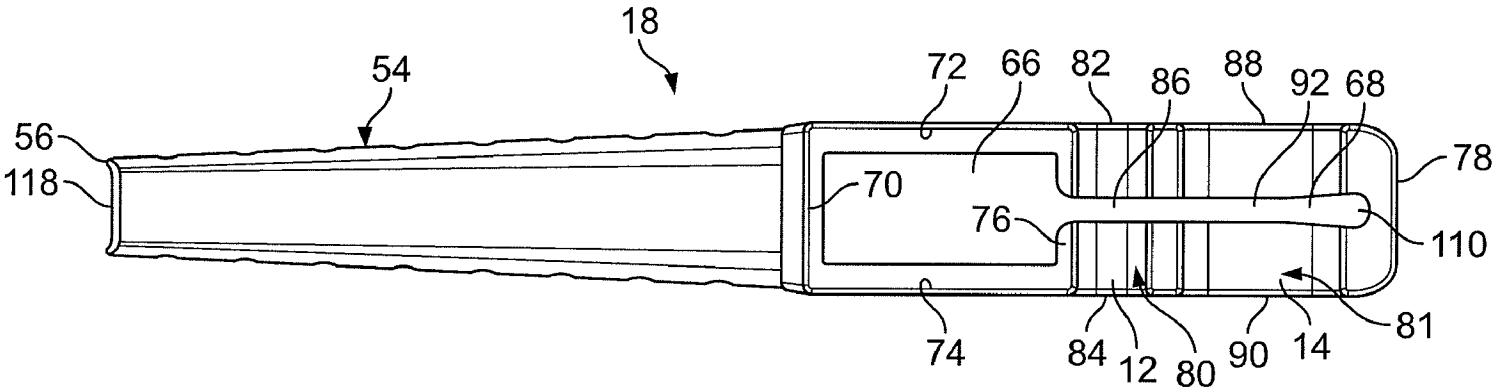
FIG. 12 is a top plan view of the handle of FIG. 11.
Figure 13:
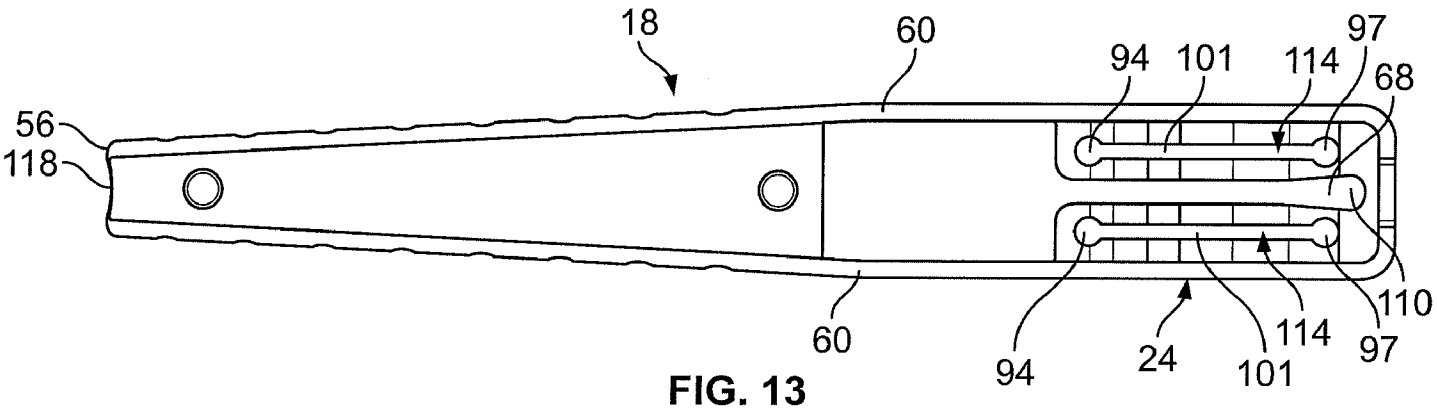
FIG. 13 is a bottom plan view of the handle of FIG. 12.
Figure 14:
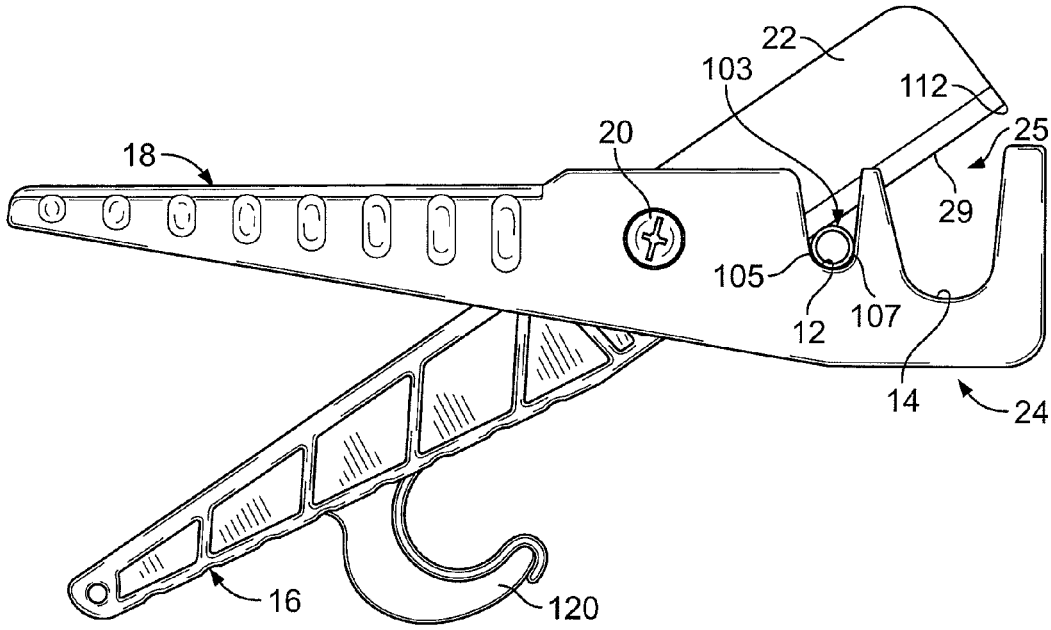
FIG. 14 is another perspective view of the cutting tool of FIG. 1 illustrating a cutting operation.
Figure 15:
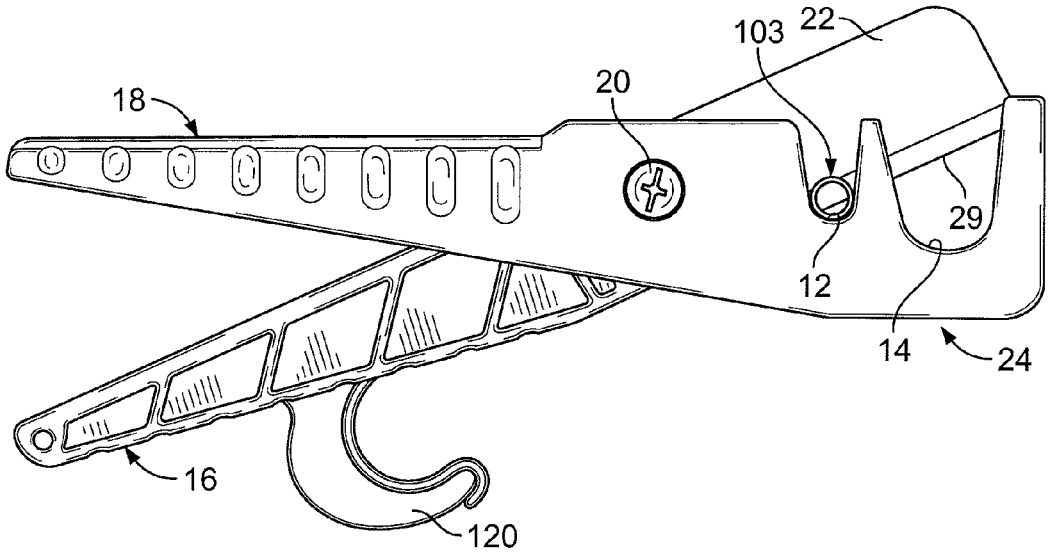
FIG. 15 is another perspective view of the cutting tool of FIG. 1 illustrating the cutting operation of FIG. 14 progressing further.

As illustrated in FIGS. 12 and 13, the second handle 18 defines a rectangular opening 66 at which the first handle 16 and the second handle 18 are connected to one another and through which the cutting blade 22 extends. An anvil slot 68 extends forward from the opening 66. The anvil slot 68 receives the longitudinally extending cutting blade 22 of the first handle 16 when the handles are pivotally connected to one another. The rectangular opening 66 is defined by: a rear edge 70 adjoining the gripping section 54, a pair of side edges 72 and 74 at the sidewall panels 60, and a front edge 76 adjoining the anvil 24. The anvil slot 68 originates at and splits the front edge 76.

The anvil 24 extends from the front edge 76 and terminates at an end wall 78. The two arcuate supports or guides 12 and 14 are located between the front edge 76 and the end wall 78 and are adjacent one another. The supports 12 and 14 extend transverse relative to the cutting blade 22. The supports 12 and 14 have concave or arcuate walls 80 and 81 for supporting conduit while being cut. The first support 12 extends between a pair of ends 82, 84. The first support 12 defines a first portion 86 of the anvil slot 68. The cutting blade 22 cuts conduit between the first and second ends 82, 84 of the first support 12. The second support 14 also extends transverse relative to the cutting blade 22 and between a pair of ends 88, 90. A second groove portion 92 of the anvil slot 68 bisects the second support 14.

The concave shape of the supporting walls 80, 81 increases the surface contact between the pipe being cut and the cutting tool 10. The increased surface contact decreases pipe deformation during the cutting operation. More specifically, it is preferred that at least a portion of the anvil supports 12, 14 generally conform to the exterior surface of the flexible conduit. As the diameter of the conduit affects the surface contact, having two differently sized concave supports 12, 14 allows the tool 10 to effectively accommodate conduit of different diameter. More particularly, the first support 12 preferably is sized to support a smaller conduit than the second support 14 that accommodates larger conduit.

Figure 18:
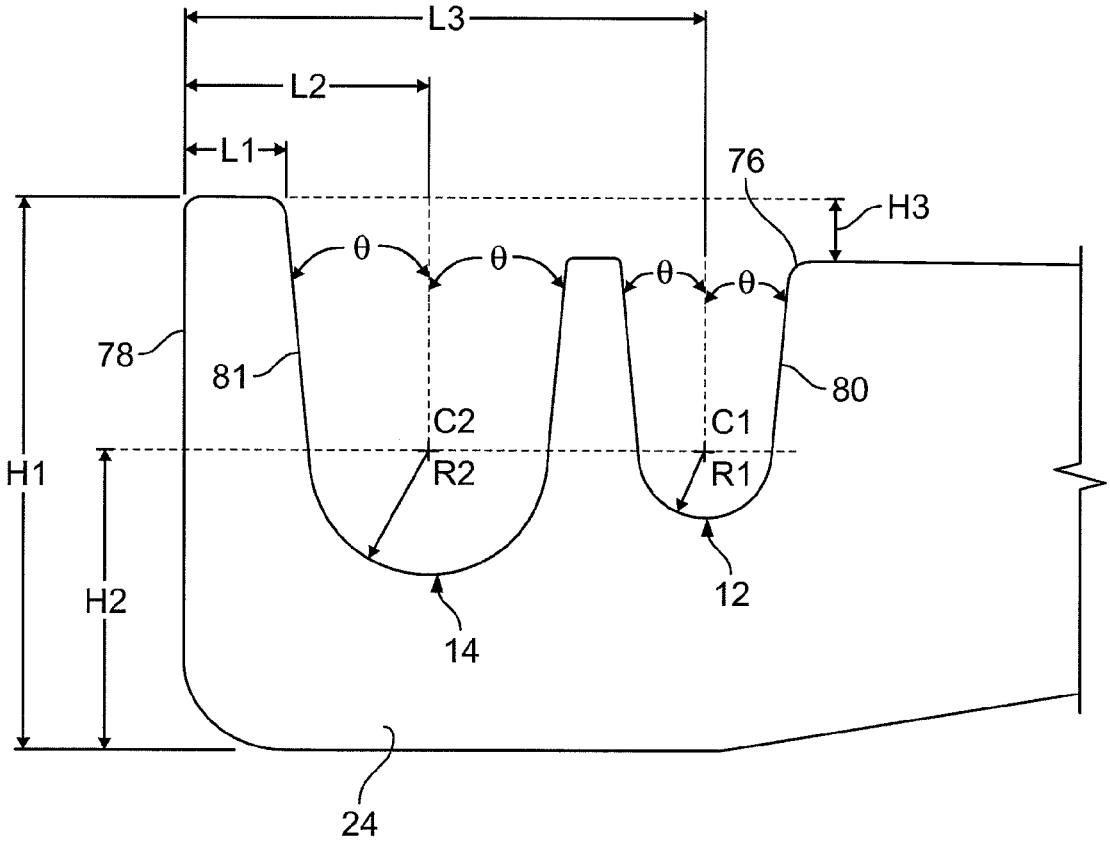
FIG. 18 is a partial side elevational view showing a portion of the tool handle of FIG. 11.

For example, with reference to FIG. 18, the first support 12 may be designed to cut ¼-inch diameter conduit. Pipe sold under the term ¼-inch pipe typically has a diameter in the range of 0.200 to 0.300 inches. To accommodate such range, the arcuate concave portion of the first support may have a radius of curvature R1 of about 0.163±0.005 inches. The second support 14 may be designed to accommodate conduit with a range of diameters between ½-inch to ¾-inch, and accordingly, the arcuate, concave portion of the second support may have a radius of curvature R2 of about 0.475±0.005 inches.

In addition, with reference to the examples in FIG. 18, the bottom of the supports 12, 14 may be substantially circular for 180°, then their support walls 80, 81 transition to a linear construction that extends outward at a predetermined angle θ, which may be about 5°±1°. The outward angle of the walls 80, 81 opens up the mouth of the support to facilitate easy insertion of the pipe into the tool for cutting. The end height H1 from a lower edge of the anvil 24 to a top edge of the end wall 78 may be approximately 1.65±0.015 inches. It is also apparent from this example that the depth of the first support 12 is less than the depth of the second support 14, and therefore, the pipe centers are located at generally the same distance from the lower edge of the anvil 24. The height H2 from the lower edge of the anvil 24 to a center C1 of the first support 12 and a center C2 of the second support 14 may be approximately 0.945±0.010 inches. The length L1 from a front end of the end wall 78 to a front edge of the second support 14 may be about 0.402±0.005 inches. The length L2 from the front end of the wall 78 to the center C2 of the second support 14 may be approximately 0.923±0.005 inches. The length L3 from the front edge of the end wall 78 to the center C1 of the first support 12 may be about 1.859±0.005 inches. The height difference H3 between the top edge of the end wall 78 and the top of the front edge 76 may be 0.25±0.015 inches.

With reference to FIGS. 10-13, the anvil slot 68 runs axially down the middle of the supports 12, 14. The slot 68 allows the cutting edge 29 of cutting blade 22 to pass completely through the conduit being cut, ensuring complete severance of the pipe. An enlarged circular opening 110 at the end wall 78 allows for flexing of the cutting blade 22 and prevents the forward knife tip 112 from nicking or damaging the end of the anvil 24.

As mentioned above, the depending channel walls 60 of the second handle 18 are spaced sufficiently apart resulting in a U-shaped channel that is wide enough to receive the first end 26 of the first handle 16 when the cutting tool 10 is assembled. In this closed configuration, the cutting blade 22 is completely sheathed within the concave anvil walls 80, 81 and the handles 16 and 18 are telescoped together. The depth of the U-shaped channel 59 decreases as it progresses from the anvil 24 to the rear end 56.

As shown in FIG. 13, to further strengthen the arcuate supports 12, 14, the underside of these walls is provided with a strengthening rib 114 on each side of the anvil slot 68. Each rib 114 includes a pair of end posts 94 and 97 and a wall 101 extending therebetween. The wall 101 supports the underside of the supports 12, 14. The preferred ribs 114 extend from the underside of the supports 12, 14 to coincide with the bottom edge of the sidewalls 60.

Figure 10:
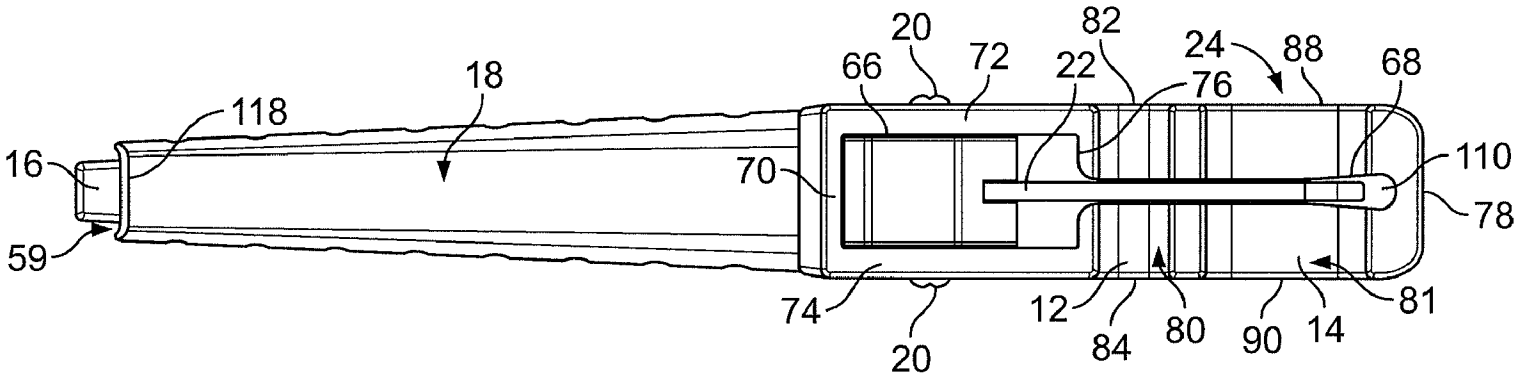
FIG. 10 is a top plan view of the cutting tool of FIG. 1 in the closed position.
Figure 11:
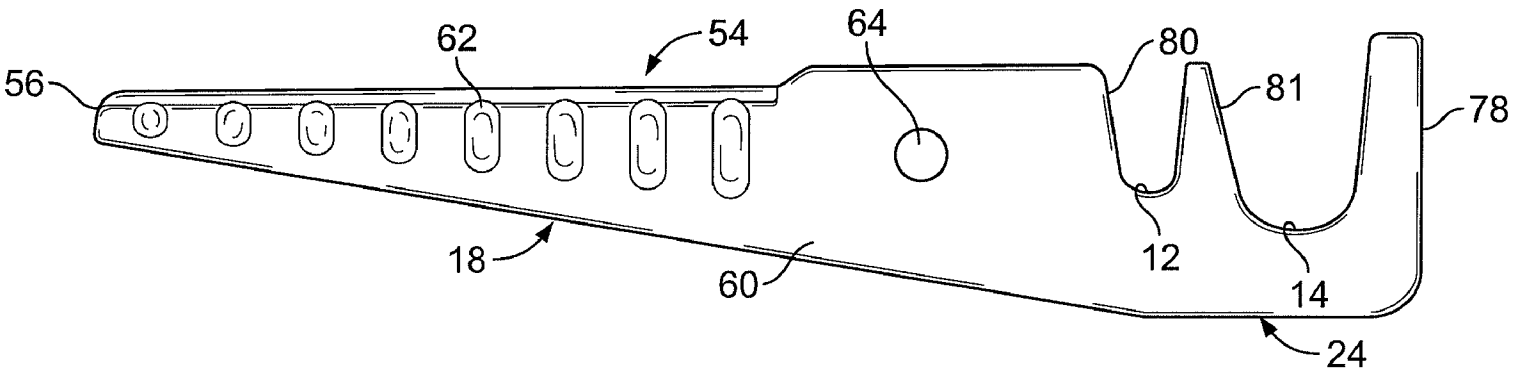
FIG. 11 is a side elevational view of one handle of the cutting tool of FIG. 1.

As illustrated in FIG. 10, to facilitate separation of the two handles 16, 18 when they are closed, the rearmost end of the second handle 18 is provided with a recess 118 or is shortened so that the rear end of the first handle 16 may project sufficiently beyond the second handle 18 to facilitate finger engagement with the rear end of the first handle 16. This arrangement also enables a string, strap, hook or other accessory to be attached to the hole 33 at the rear of the first handle 16.

With reference to FIGS. 7-9, an optional stop 120, for a finger may be added to preferably the first handle 16. For instance, the stop 120 may be in the form of a finger loop that extends from the panel wall 40 of the first handle 16. The finger loop 120 allows the user to easily separate the first and second handles 16 and 18 to open the jaw 25. For instance, a user's finger, such as the index finger, is situated in the finger loop and when extended away, causes the cutting blade 22 to move from its closed position sheathed in the anvil slot 68. By opening the jaw 25, a piece of pipe can be placed into the anvil 24 for cutting.

The cutting tool 10 can be made from a large number of suitable materials, including moldable nylon 6. This material is particularly suitable because of its weight, hardness, durability, and easy-of-use. Further, the tool 10 has smoothly rounded surface edges, making it more aesthetically pleasing and comfortable for the user to manipulate during use.

Figure 16:
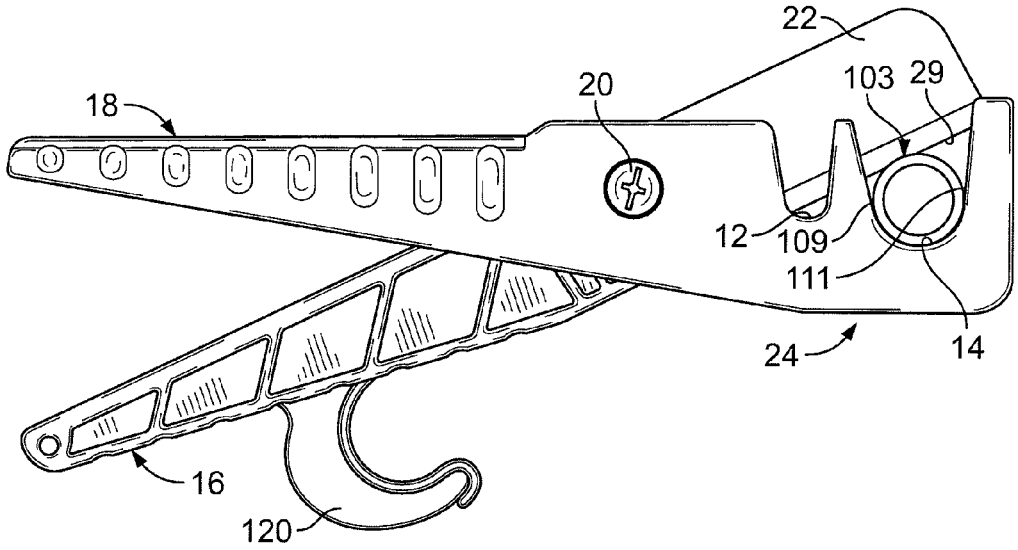
FIG. 16 is another perspective view of the cutting tool of FIG. 1 illustrating another cutting operation.
Figure 17:
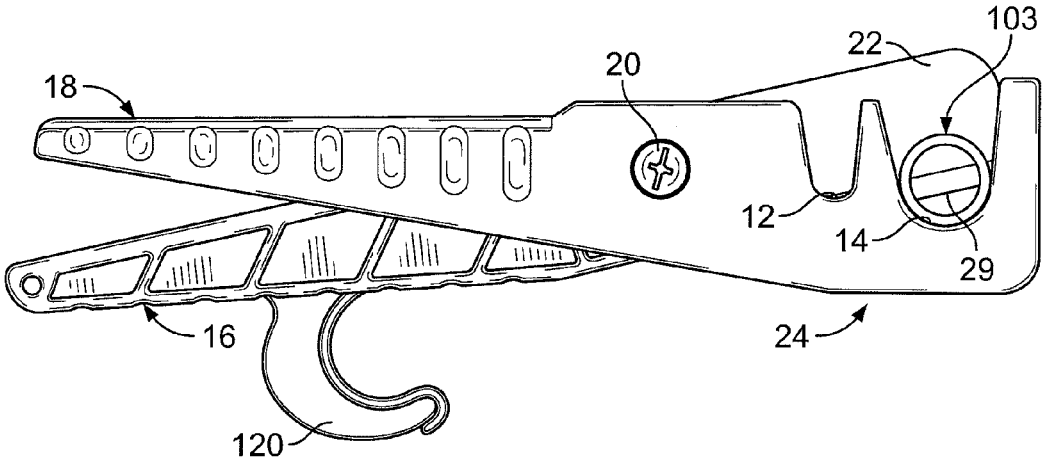
FIG. 17 is another perspective view of the cutting tool of FIG. 16 illustrating the cutting operation of FIG. 16 progressing further.

In FIGS. 14-17, there is illustrated a cutting operation for both the smaller support 12 (FIGS. 14 and 15) and the larger support 14 (FIGS. 16 and 17). In each instance, the cutting blade 22 aligns transversely with a pipe 103 at the location of the cut. After the pipe 103 is extended through one of the supports 12 and 14, the handles 16 and 18 are squeezed, like pliers, to bring the cutting blade 22 to bear on the pipe 103.

During the cutting operation, the arcuate supports 12 and 14 engage the exterior of the pipe to resists deformation in the forward and rearward direction with respect to the cutting tool 10. In the illustrated operations of FIGS. 14 and 15, the first support 12 engages the pipe from a first point 105 around to a second point 107. This range of support is preferably at least 180°. It counters the cutting forces applied to the blade 22 in the downward and forward directions. The front and rear support prevents the blade 22 from flattening the conduit during cutting. As illustrated in FIGS. 16 and 17, the same effect is provided between a first point 109 and a second point 111 of the second support 14 for the larger conduit. This range of support is preferably 180°.

With the appropriate support, the conduit is severed quickly, cleanly, and easily by squeezing the tool handles together. Indeed, it has been experienced that less force is required to cut the pipe and rotating the tool or pipe during the cutting operations may not always be necessary. A smooth, clean, sharp cut is provided that does not damage the conduit ends, leaving them cleanly cut at right angles and suitable for insertion of the appropriate pipe fittings, without the need to reform the pipe to its circular cross-section.

While the invention has been described with respect to specific examples, including presently preferred modes of carrying out the invention, those skilled in the art will appreciate that there are numerous variations and permutations of the above-described apparatus that fall within the spirit and scope of the invention as set forth in the appended claims.

What is claimed is:

1. A tool for cutting flexible conduit comprising:

a first elongated handle;

a second elongated handle pivotably connected to the first elongated handle;

a cutting blade attached to a first handle end of the first elongated handle;

an anvil attached to a second handle end of the second elongated handle;

the cutting blade and the anvil forming a cutting jaw for cutting a flexible conduit therebetween as the cutting blade and anvil are pivoted toward one another; and the anvil having at least a first support capable of engaging a flexible conduit at least at a generally forward tangent point of a flexible conduit along a first tangent generally perpendicular to the cutting blade prior to cutting and a generally rearward tangent point of a flexible conduit along a second tangent generally perpendicular to the cutting blade prior to cutting, the first support located so as to engage and resist deformation of a flexible conduit while being cut, and wherein the first support extends beyond the generally forward tangent point to further support against deformation while the flexible conduit is being cut.

2. The tool of claim 1 wherein the first support has a first support end and a second support end and wherein the cutting blade operates for cutting between the first support and second support ends.

3. The tool of claim 2 wherein the first support defines a first slot that receives the cutting blade during cutting operations.

4. The tool of claim 3 wherein at least a portion of the first support of the anvil conforms at least generally to an exterior profile of a flexible conduit being cut.

5. The tool of claim 3 wherein at least a portion of the first support of the anvil is arcuate to conform at least generally to an exterior surface of a flexible conduit.

6. The tool of claim 2 wherein the anvil comprises a second support capable of engaging a flexible conduit at least at a generally forward tangent point of a flexible conduit along a first tangent generally perpendicular to the cutting blade and a generally rearward tangent point of a flexible conduit along a second tangent generally perpendicular to the cutting blade, the second support extends transverse of the cutting blade, the second support having a third support end and a fourth support end and wherein the cutting blade operates for cutting between the third support end and the fourth support end.

7. The tool of claim 6 wherein the second support defines a second slot that receives the cutting blade during cutting operations.

8. The tool of claim 7 wherein at least a portion of the first support and the second support of the anvil conform at least generally to an exterior profile of a flexible conduit being cut.

9. The tool of claim 8 wherein at least a portion of the first support and the second support of the anvil are arcuate to conform at least generally to an exterior surface of a flexible conduit.

10. The tool of claim 9 wherein the first support is designed to cut a conduit of a first general size and the second support is designed to a cut a conduit of a second general size.

11. The tool of claim 7 wherein the first support is designed to cut a conduit of a first general size and the second support is designed to a cut a conduit of a second general size.

12. The tool of claim 6 wherein the first elongated handle and the second elongated handle are nested for pivotally attaching one another.

13. The tool of claim 12 wherein the second elongated handle defines a channel to receive a portion of the first elongated handle to nest one another for pivotally attaching one another.

14. The tool of claim 6 further comprising a finger stop extending from at least one of the first and second elongated handles.

15. The tool of claim 2 further comprising a finger stop extending from at least one of the first and second elongated handles.

* * * * *